US005426871A

United States Patent [19]

Spademan et al.

[11] Patent Number: 5,426,871

[45] Date of Patent: Jun. 27, 1995

[54] ANKLE FLEXION LIMITING DEVICE

[76] Inventors: Richard G. Spademan; Howard L. Liverance, both of 2600 Capitol Ave., Sacramento, Calif. 95816

[21] Appl. No.: 197,221

[22] Filed: Feb. 16, 1994

Related U.S. Application Data

[63] Continuation of Ser. No. 902,781, Jun. 23, 1992, abandoned, which is a continuation of Ser. No. 629,044, Dec. 14, 1990, abandoned, which is a continuation of Ser. No. 179,141, Apr. 8, 1988, abandoned, which is a continuation-in-part of Ser. No. 751,828, Jul. 5, 1985, abandoned, which is a continuation-in-part of Ser. No. 461,832, Jan. 28, 1983, abandoned, which is a continuation-in-part of Ser. No. 50,436, Jun. 20, 1979, Pat. No. 4,494,324, which is a continuation-in-part of Ser. No. 886,946, Mar. 15, 1978, Pat. No. 4,382,342.

[51] Int. Cl.[6] ..... A43B 5/04

[52] U.S. Cl. ..... 36/120; 36/121

[58] Field of Search ..... 36/2.5, 1.5, 54, 81, 36/88, 89, 93, 109, 117–121

[56] References Cited

U.S. PATENT DOCUMENTS

| | | | |
|---|---|---|---|
| 3,475,835 | 11/1969 | Kovar | 36/1.5 |
| 3,713,231 | 1/1973 | Mochizuki | 36/121 |
| 3,722,112 | 3/1973 | Morgan | 36/121 |
| 3,828,448 | 8/1974 | Leonildo | 36/119 |
| 3,855,716 | 12/1974 | Hutchinson | 36/119 |
| 3,922,800 | 12/1975 | Miller et al. | 36/117 |
| 3,988,842 | 11/1976 | Rathmell | 36/121 |
| 4,021,053 | 5/1977 | Willi | 36/89 |
| 4,160,332 | 7/1979 | Salomon | 36/119 |
| 4,196,530 | 4/1980 | Delery | 36/119 |
| 4,406,073 | 9/1983 | Spademan | 36/119 |
| 4,420,893 | 12/1983 | Stephan | 36/3 R |
| 4,426,796 | 1/1984 | Spademan | 36/119 |
| 4,447,968 | 5/1984 | Spademan | 36/119 X |
| 4,455,768 | 6/1984 | Salomon | 36/121 |
| 4,494,324 | 1/1985 | Spademan | 36/119 |
| 4,523,395 | 6/1985 | Borsoi | 36/119 |
| 4,534,122 | 8/1985 | MacPhail | 36/119 |
| 4,677,769 | 7/1987 | Ahmad . | |
| 4,928,405 | 5/1990 | Spademan . | |

FOREIGN PATENT DOCUMENTS

| | | | |
|---|---|---|---|
| 0145704 | 6/1985 | European Pat. Off. | 36/119 |
| 2086994 | 12/1971 | France | 36/119 |
| 2496423 | 6/1982 | France | 36/117 |
| 2544969 | 11/1984 | France . | |
| 2321817 | 11/1973 | Germany | 36/3 R |
| 2953208 | 9/1980 | Germany | 36/117 |
| 484643 | 3/1970 | Switzerland | 36/119 |
| 506261 | 6/1971 | Switzerland | 36/119 |
| 8002789 | 12/1980 | WIPO . | |
| WO85/03416 | 8/1985 | WIPO | 36/117 |
| 9219117 | 11/1992 | WIPO . | |

*Primary Examiner*—Jimmy G. Foster
*Assistant Examiner*—Thomas P. Hilliard
*Attorney, Agent, or Firm*—Townsend and Townsend Khourie and Crew

[57] ABSTRACT

A device for limiting dorsiflexion past a chosen, optimum angle while permitting further forward flexion of the leg relative to the sport shoe contact surface. The device is advantageously used with a sport shoe including a sole, a shell mounted to the sole for receipt of the user's foot and an upwardly extending movable tongue or cuff mounted to the shell. The sole includes an upper foot supporting surface. In one embodiment the tongue is positioned so that dorsiflexion of the user's leg causes the tongue to move forward. The tongue is coupled to the upper foot supporting surface so that dorsiflexion between an initial angle and an optimum angle is relatively unrestrained but further dorsiflexion past the optimum angle is minimized or eliminated by the concurrent lifting of the upper foot supporting surface. In another embodiment the sole is a unitary member and the upper foot supporting surface is a part of the sole. In this embodiment a tongue assembly stops dorsiflexion past an optimum angle. Further forward flexion of the leg relative to the sport shoe contact surface after the optimum dorsiflexion angle has been attained tends to raise the entire heel end of the sole.

20 Claims, 6 Drawing Sheets

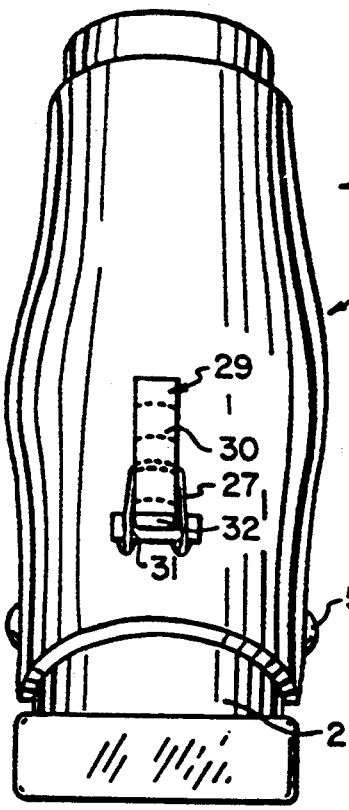
FIG. 2
FIG. 1
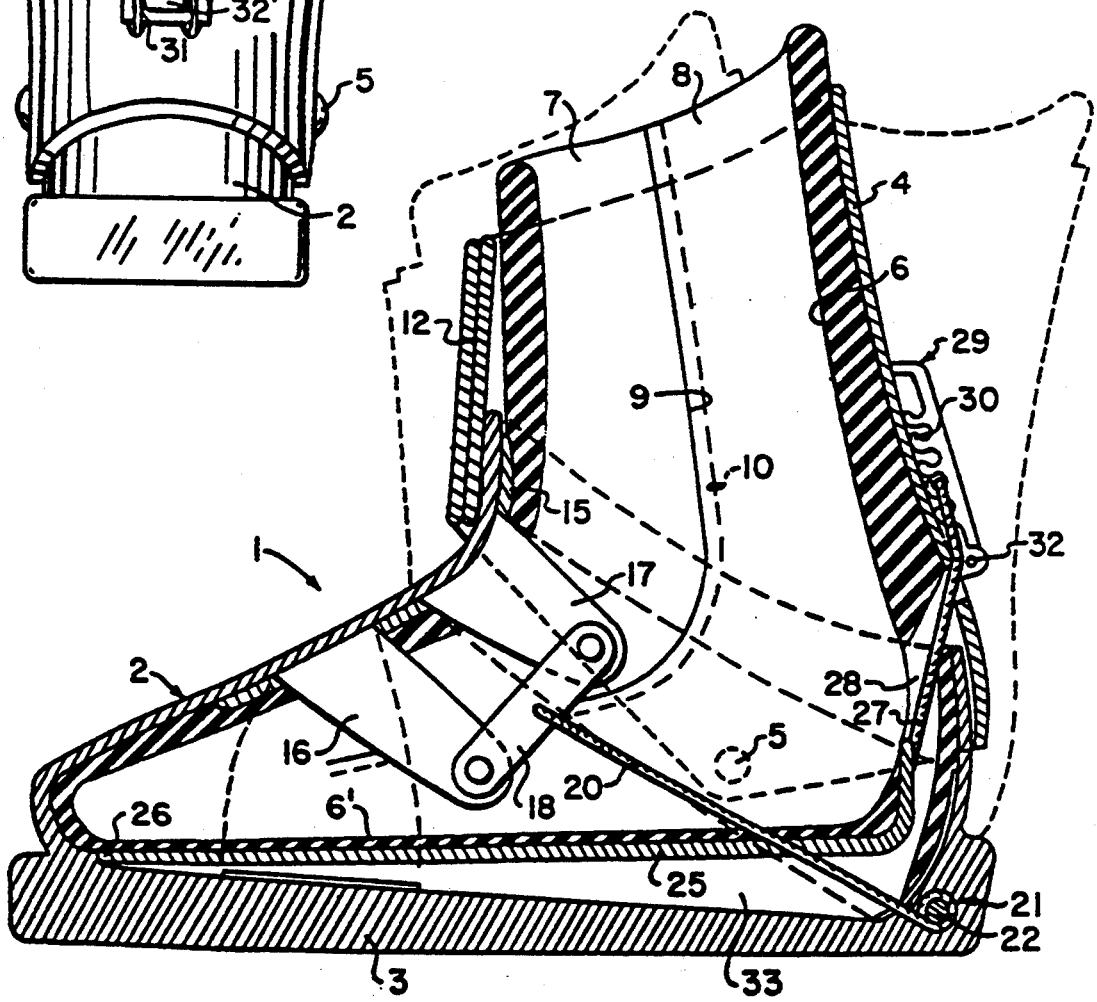

ANKLE FLEXION LIMITING DEVICE

This is a continuation of U.S. patent application Ser. No. 07/902,781 filed Jun. 23, 1992, now abandoned; which was a continuation of U.S. patent application Ser. No. 07/629,044 filed Dec. 14, 1990, now abandoned; which was a continuation of U.S. patent application Ser. No. 07/179,141 filed Apr. 8, 1988, now abandoned; which was a continuation-in-part of U.S. patent application Ser. No. 06/751,828 filed Jul. 5, 1985, now abandoned; which was a continuation-in-part of U.S. patent application Ser. No. 06/461,832, filed Jan. 28, 1983, now abandoned; which was a continuation-in-part of U.S. patent application Ser. No. 06/050,436 filed Jun. 20, 1979, now U.S. Pat. No. 4,494,324; which was a continuation-in-part of U.S. patent application Ser. No. 05/886,946, filed Mar. 15, 1978 now U.S. Pat. No. 4,382,342.

BACKGROUND OF THE INVENTION

The present invention relates to a device, typically incorporated in a sport shoe, which prevents or at least minimizes dorsiflexion of a user's foot relative to the user's leg beyond a predetermined optimum angle while permitting further forward flexion of the leg relative to the sport shoe performing surface. The invention is particularly well suited for use while skiing in downhill ski boots but is also usable for other sport shoes where limiting dorsiflexion to some optimum angle during the sport performance is desired.

A sport shoe forms the connection between an athlete and the surface on which he or she performs, such as the ski and mountain slope for skiing, the playing field for such sports as soccer, football or tennis, or the road or path along which a runner runs. Major maneuvers of the athlete require the transmission of forces between the runner's leg and the ground via the sport shoe. These maneuvers are accompanied by conscious immovement or movement of the athletes ankle, that is, muscular activity to immobilize or mobilize the foot relative to the leg. Compared to other major body joints there is weak muscular control and limited range of motion of the foot in dorsiflexion.

To enable the sport shoe to efficiently transmit often significant forces, the sport shoe must provide the proper support for the ankle. At the same time, the sport shoe must be designed so that it allows the athlete to perform all necessary ankle movements and make the most efficient use of his or her muscular strength when performing such movements.

Although this general description of the function of a sport shoe applies to use in virtually all sports, the degree of movement and the magnitude of force to be applied by the lower extremity to execute various maneuvers are particularly evident in downhill skiing. As a consequence, of all the sport shoes, downhill ski boots are the most elaborate. Briefly, a downhill ski boot provides an exterior shell for the foot and an exterior cuff for the leg which extends well above the ankle. Such boots permit a forward and rearward flexion of the leg with respect to the foot from a preselected "normal" position or dorsiflexion and plantarflexion of the foot relative to the leg, respectively, but they prevent significant medial and lateral or adduction and abduction movements of the foot with respect to the leg, i.e. in all other directions the entire boot is relatively rigid. In the past, this has been accomplished by constructing downhill ski boots of a two-part, substantially rigid shoe defined by a lower foot section and an upper leg section that is typically pivotally attached to the lower foot section. In the interior of the shell is a relatively soft liner. In use, the boot and in particular the sole, which forms part of the lower foot section, is engaged by a binding attached to the ski to thereby rigidly connect the boot to the ski.

While skiing, the boot tightly encompasses the athlete's foot and leg, typically by means of one or more buckles which tighten the boot against the foot and the lower leg. Because of the many gross movements and the exertion of large forces during many turning maneuvers executed by a downhill skier, the boot must be relatively tight on the foot and leg. Frequently, the required tightness is uncomfortable, can reduce blood circulation, and can lead to pain and fatigue. Any looseness of the boot, on the other hand, greatly compromises the athlete's ability to maneuver the skis because of the poor transmission of forces from the leg to the skis.

To overcome this problem, the applicant has previously invented ski boots having dynamic fitting systems disclosed in the above referenced patent applications. Such fitting systems allow a relatively snug and comfortable fit of the boot on the athlete's leg. However, the fit is momentarily tightened in response to relative movement of the leg, typically between his or her foot and leg. Normally, this is accomplished by providing an instep strap, a movable footbed, an adjustable tongue, or the like, which are operatively connected with the lower shell and the upper cuff so that upon relative movement between them, the tightness of the fit of the boot increases proportionally to the extent to which the upper cuff moves relative to the lower shell away from a "normal" position. In ski boots, the "normal" position of the upper cuff typically includes some degree of forward angulation of the upper cuff with respect to the lower shell. Any additional forward flexion of the lower leg increases the tightness of the fit. Upon return of the upper cuff to its normal position, the tightness of the fit lessens.

Actual tests with such boots have shown that they constitute a remarkable improvement over conventional ski boots which lack a dynamic fitting system. Specifically, discomfort, pain, poor circulation and fatigue which often accompanied prior art ski boots have been substantially eliminated. The tight fit required for executing turning maneuvers and the like during skiing is attained during the turning maneuver. At all other times the fit is less tight and more comfortable.

In spite of the significant improvement provided by the dynamic fitting systems discussed above, sport shoes in general and ski boots fitted with such systems in particular can be improved. Specifically, such dynamic fitting systems affect the tightness of the fit as soon as there is any movement between the lower shell and the upper cuff. This, applicant has discovered, is not always desirable because it is essential that ski boots, for example, provide for an adequate range of motion for the ankle joint in certain skiing conditions. This range of motion allows the foot and shoe to provide a stable platform when the athlete makes subtle changes in the center of gravity of his or her body. An adequate range of ankle motion is also highly desirable to accommodate the finer muscle movements which take place during certain piloting maneuvers in skiing. In other sports such as soccer, basketball and tennis, sudden stops and starts, rapid accelerations and quick changes in direction while performing in these sports demand that the ankle have this mobility to assure center of gravity stability and muscular control for the athlete.

Yet, the sport shoe should also enable the athlete to most advantageously utilize his or her maximum muscle strength. Most maneuvers requiring great strength occur in dorsiflexion. In skiing, for example, major changes in direction involve the efficient muscular control of the foot in dorsiflexion for the effective shift in the center of gravity, anticipation, angulation and edging. To obtain the optimum muscular control of the ankle in this posture of dorsiflexion there is a particular position that must be attained and retained from which the various strength related maneuvers can be executed. This position is referred to as the optimum dorsiflexion angle. The existence of an optimum dorsiflexion angle can be traced to certain observed physiologic characteristics of muscle and the anatomical orientation of the flexor and extensor muscles of the leg and foot. Among the several characteristics of muscle that must be considered are the following:

(1) muscle mass strength is greatest when the muscle is near its greatest length (Kreighbaum, et al., *Biomechanics, A Qualitative Approach for Studying Human Movement,* Burgess Publishing Co., at pp. 123, 124);

(2) muscle mass strength decreases with increased velocity of contraction (Piscopo and Baley, *Kinesiology, The Science of Movement,* John Wiley & Sons, at pp. 150–151); and (3) muscle mass strength is dependent upon the angle of pull against the boney lever arm (Cooper, et al., *Kinesiology,* The C. V. Mosby Co., at pp. 116–123).

In addition, muscle mass strength is greatest when there is no contraction (Cooper, et al., *Kinesiology,* The C. V. Mosby Co., at p. 109).

Applicant has discovered that optimum strength for skiing maneuvers is attained when the relative angular inclination between the foot and the leg, i.e. dorsiflexion, is approximately 12°. The 12° dorsiflexion angle, however, does not provide proper body balance or positioning of the center of gravity during all phases of skiing. In downhill skiing, when leaving the fall line, often a greater forward flexion of the leg relative to the ski is required than the optimum dorsiflexion angle. This forward flexion is necessary to resist the sideslip of the ski caused by the curved trajectory and pull of gravity. During this drive down the fall line, as the edge angle is increased, the ski becomes more resistant to sideslip, develops an increasing reverse camber and holds better at the tip and tail. The arc of the turn, the rate of movement, and the closeness to the fall line determines the angulation and therefore forward flexion of the leg required to resist the sideslip caused by the centrifugal force. Yet, prior art dynamic fitting systems incorporating a movable footbed maintained a given angularity between the footbed and the cuff. If that angularity is chosen for optimum efficiency, e.g. at 12° proper balance will not be attained much of the time. On the other hand, if the relative forward angulation of the cuff relative to the footbed is chosen at a lesser value, say between 7° to 9° forward angulation as is typical, optimum strength cannot be attained.

From the foregoing, it is apparent that there is a present need for an improved dynamic fitting system which includes a movable footbed that is constructed so as to provide some freedom of motion for the ankle joint without tightening the fit. Further, there is a present need for a dynamic fitting system in which the relative angular inclination between the foot and the leg is such as to provide comfort for the athlete, and which readjusts the relative angular inclination during times when maximum strength is required and allows further forward flexion of the leg relative to the shoe performing surface, so as to enable the athlete to exert the greatest possible force at that instance.

SUMMARY OF THE INVENTION

Broadly speaking, the present invention is directed to a device mounted to the user at the intersection of the user's foot and leg to prevent dorsiflexion past a predetermined, optimum angle while performing a sport while permitting further forward flexion of the leg relative to the sport shoe performing surface. The device finds particular utility when used with, or incorporated into the structure of, a sport shoe. The sport shoe commonly includes a sole, a shell extending from the sole for receipt of the user's foot, and a movable tongue or cuff mounted to the shell. The sole, shell and tongue or cuff are constructed so that the user can move his or her foot relatively freely over a limited dorsiflexion angle. Thereafter, any significant further dorsiflexion of the foot relative to the leg is prevented. Dorsiflexion, as used in this application, means the backward flexion of the foot or the forward flexion of the leg relative to the foot. Dorsiflexion is measured from the position where the leg is perpendicular to the foot.

The sole includes an upper foot supporting surface or footbed and is constructed so that a rearward or heel portion of the upper surface can move upwardly while the region of the lower surface of the sole generally forward of the ball of the foot remains flat on the ski, playing field, floor or track.

In one set of embodiments the tongue is positioned so that dorsiflexion past an optimum dorsiflexion angle causes the tongue to move forward. The tongue is coupled to the upper foot supporting surface so that forward flexion of the user's leg from an initial rest angle to an optimum dorsiflexion angle is relatively unrestrained; further dorsiflexion of the foot relative to the leg past the optimum angle is substantially eliminated by the lifting of at least the heel portion of the upper foot supporting surface.

In one specific embodiment applicant's invention is incorporated in a downhill ski boot having a rigid lower sole, the bottom surface of which is rigidly connected to the ski. A movable, relatively stiff footbed or upper foot supporting surface of the sole overlies the lower sole and is constructed so that at least its heel portion can pivot upwardly relative to the lower sole about a pivot point. The pivot point is typically located in the metatarsal phalangeal region, that is the region underlying the ball of the user's foot. The pivotal footbed can be therefore either fully rigid along its entire length or substantially rigid rearwardly of the pivot point. By substantially rigid, it is meant that the footbed has sufficient rigidity to allow lifting of the user's foot in the region behind the ball of the foot.

In a ski boot the earlier discussed movable tongue is defined by the cuff, or at least the forward portion of the cuff, which is secured to the shell of the ski boot for movement about a pivot axis located near the user's ankle. The cuff is coupled to the footbed so that dorsiflexion between an initial dorsiflexion angle and the optimum angle does not raise the footbed. As a result, the skier can relatively freely move his or her foot between the initial and optimum dorsiflexion angles. Attempted dorsiflexion past the optimum angle raises the heel portion of the footbed, thereby minimizing or eliminating dorsiflexion movement past the optimum angle because the angularity between the footbed and the cuff remains constant. Further flexion of the leg relative to the sole bottom and thus the ski is possible for further angulation, edging or lowering the center of gravity. This further flexion causes the fit of the ski boot to tighten because as the footbed is raised, the foot is pressed with increasing force upwardly against the inside of the shell. Yet, the relative angle between the user's foot and lower leg remains in the optimum range.

In another embodiment, the present invention is used with a sport shoe having a semirigid lower sole. In such case the sole incorporates a separately movable upper foot supporting surface or footbed, having a substantially rigid portion between the heel and the ball of the foot and a flexible portion forward of the ball of the foot. An upwardly extending, relatively rigid tongue is coupled to the heel portion of the footbed so that flexion of the leg relative to the shoe sport performing surface past the optimum angle pivots the tongue forwardly to correspondingly raise the footbed. After the footbed is raised a certain amount, a stop on the tongue and pressure of the foot against the upper inside of the shell prevents further dorsiflexion so further forward flexion of the leg causes the sole base to flex without changing the dorsiflexion angle.

One aspect of the invention contemplates to limit dorsiflexion during a sport performance to the optimum angle without the use of a movable footbed. In a sport shoe embodiment made according to this aspect, the upper surface of a shoe having a unitary but semiflexible sole supports the user's foot. The shoe is used to mount a tongue assembly having an upwardly extending tongue adjacent the front of the user's lower leg just above the foot. The tongue assembly includes a stop which limits forward movement of the tongue past a point corresponding to the optimum dorsiflexion angle. Further forward flexion of the user's leg relative to the sport performing surface, once the optimum dorsiflexion angle has been reached, will not change the dorsiflexion angle. Instead, such further forward flexion results in the flexion of both the sole of the shoe and the foot at the metatarsal phalangeal region of the user's foot.

Other features and advantages of the present invention will appear from the following description in which the preferred embodiments have been set forth in detail in conjunction with the accompanying drawings.

BRIEF DESCRIPTION OF THE DRAWINGS

FIG. 1 is a cross-sectional side view of a ski boot showing a movable footbed.

FIG. 2 is a rear view of the embodiment of FIG. 1.

DETAILED DESCRIPTION OF THE PREFERRED EMBODIMENTS

Figure 3:
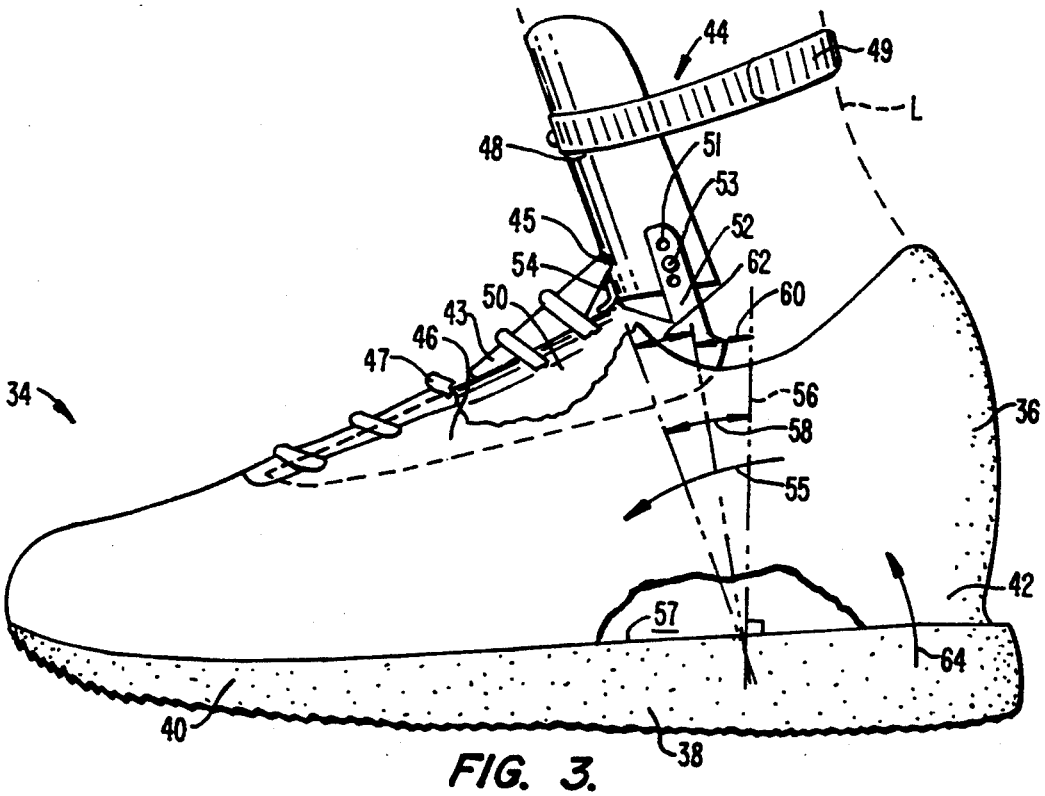
FIG. 3 is a side view of a sport shoe embodiment of the invention with a semiflexible sole.

FIGS. 1 and 2 disclose a sport shoe in the form of a ski boot 1 which is rigidly connected to a ski while performing and includes a shell 2 extending from a rigid sole 3. A cuff 4 is pivotally mounted to lower shell 2 via a pair of pivot fittings 5. Cuff 4 overlays at 12 at the front of ski boot 1. A liner 6 covers the interior of boot 1 and includes a forward section 7, a rearward section 8, and a sole liner 6'. Forward and rearward sections 7, 8 overlap along lines 9, 10.

A tongue 15 is housed between forward section 7 and lower shell 2 at the instep of the shoe. Straps 16, 17 extend over tongue 15 and are used to achieve the initial desired close fit. One end of each of the straps is attached to sole 3 while the other ends are pivotally mounted to the ends of a link 18. Link 18 is coupled to an adjustment mechanism 21 by a cable 20. Rotating shaft 22 of adjustment mechanism 21, which is typically accomplished by inserting a screwdriver or coin within a slot on the end of shaft 22, allows the user to set the tightness of the fit of the boot.

Sole 3 includes an upper sole surface or movable footbed 25 upon which sole liner 6', which defines the upper foot supporting surface of boot 1, is mounted. Footbed 25 is substantially rigid and can be pivoted upwardly about a hinge 26 near the toe of the boot.

A cable 27 is connected to the heel end of movable footbed 25 and extends through a cable slot 28 in ski boot 1. Cable 27 passes through apertures in cuff 4, around a roller guide 31 and through one of several hooks 30 on buckle 29. Buckle 29 pivots about hinge 32 to draw cable 27 and thus the heel end of movable footbed 25 upwardly. Dorsiflexion of the foot causes cuff 4 to pivot about pivot fittings 5 to raise movable footbed 25. This decreases the room within ski boot 1 to dynamically tighten the boot on the user's foot from the close fit.

The present invention differs from the disclosure and teaching of the parent case in that, first, a certain amount of dorsiflexion of the foot is allowed without raising of the upper foot supporting surface of the sole so that the dorsiflexion angle can be changed over a limited range. Second, the upper foot supporting surface need not be carried by a movable footbed but can be the upper surface of a unitary, semiflexible sole. This difference is illustrated in the embodiment of FIG. 3. FIG. 3 also discloses the primary aspect of the invention by which dorsiflexion is limited without the need for a movable footbed. In all of the disclosed embodiments, the leg can flex forward relative to the sport shoe sport performing surface beyond the optimum dorsiflexion angle.

FIG. 3 discloses a sport shoe in the form of a tennis shoe 34 including a shell 36 on a semiflexible sole 38. Shell 36 is usually of a flexible material, such as leather or nylon. Sole 38 is flexible in the metatarsal phalangeal area 40, generally below the ball of the user's foot but is less flexible rearwardly thereof, that is toward the thicker heel 42 of shoe 34. Sole 38 may exhibit some flexibility along its entire length, although flexion of the sole will generally occur at area 40 due to the flexion of the user's toes in that area.

A tongue assembly 44 is mounted between the user's foot and the instep portion 46 of shell 36 below a conventional arrangement of lace 47. Tongue assembly 44 includes a relatively stiff lower tongue 50 extending forwardly over the upper surface of the foot, a pair of adjustable straps 52 connecting the upper and lower tongues, and a hinge 54 about which the upper and lower tongues can pivot when the straps are adjusted. A wedge 44 is pivotably secured to upper tongue 48 by a rivet 45 or the like. A strap 49 secures the upper tongue to the user's leg. Lower tongue 50 may be permanently secured to instep portion 46 or may be removably placed between the user's instep and portion 46.

In the use of sport shoe 34 the user first tightens and ties the lace in the conventional manner to secure a snug or close fit of the shell on the foot and determines the desired optimum angle of dorsiflexion or the angle may be preset at the factory. Dorsiflexion is measured in the direction of arrow 55 from axis 56 which extends at a right angle from the upper foot supporting surface 57 of sole 38. Strap 52 is adjusted by engaging the appropriate hole 51 therein with a peg or the like 53 in the upper tongue 48 so that the angle 58 between axis 56 and the upper tongue is equal to the optimum dorsiflexion angle. Assuming the initial dorsiflexion is an angle 60, dorsiflexion over an additional angle 62 can take place before further dorsiflexion is prevented by tightening of straps 52. Further forward flexion of the user's leg will not result in further dorsiflexion but rather will cause sole 38 to flex and upper supporting surface 57 to pivot upwardly about area 40 in the direction of arrow 64. This upward pull on heel 42, which lifts surface 57 from the sport performing surface, is through shell 36 of shoe 34. This flexing of the sole occurs with conventional semiflexible sport shoes. However such conventional shoes do not and cannot limit dorsiflexion.

In practice, tongue assembly 44 will not prevent all further dorsiflexion beyond angle 58. However, as the user's lower leg flexes forwardly, upper support surface 57 is pulled upwardly in the direction of arrow 64 which minimizes or eliminates further dorsiflexion. Thus the degree of dorsiflexion past the optimum dorsiflexion angle is reduced or eliminated. Included within this aspect of the present invention is to allow the flexion of sole 38, and thus raising of heel 42 from the performing surface before optimum dorsiflexion angle 58 is reached. However once it has been reached sport shoe 34 substantially eliminates further dorsiflexion for optimum performance of the athlete.

Sport shoe 34 illustrates the primary aspect of the invention. Shoe 34 in effect acts as a means for mounting tongue assembly 44 adjacent the instep of the foot. Thus, the aspect of the invention by which dorsiflexion is limited to a maximum angle may be accomplished by using other structures for mounting tongue assembly 44. For example, lower tongue 50 may be secured directly to the leg or foot.

In use, if wedge 43 passes beneath the loops of lace 47 after lace 47 has been tightened and tied in the conventional manner to secure a close fit of the shell on the user's foot, the lace and shell are further tightened from the close fit as tongue 48 is pivoted forwardly when the leg is flexed forwardly. The strap 49 pulls the tongue rearwardly loosening the shell to the close fit as the leg is extended toward the "normal" position.

Figure 4A:
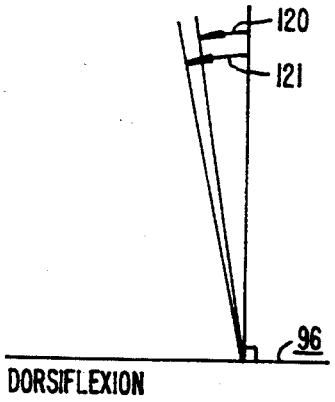
FIGS. 4A and 4B represent the respective foot dorsiflexion angles and leg forward flexion angles accompanying use of the sport shoe of FIG. 4.
Figure 4B:
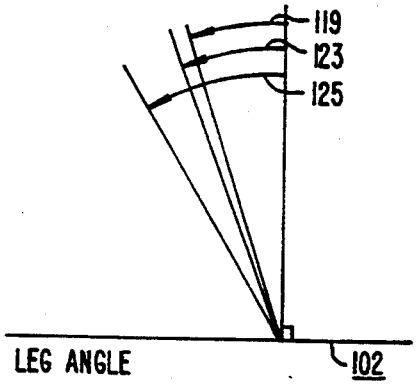
Figure 4:
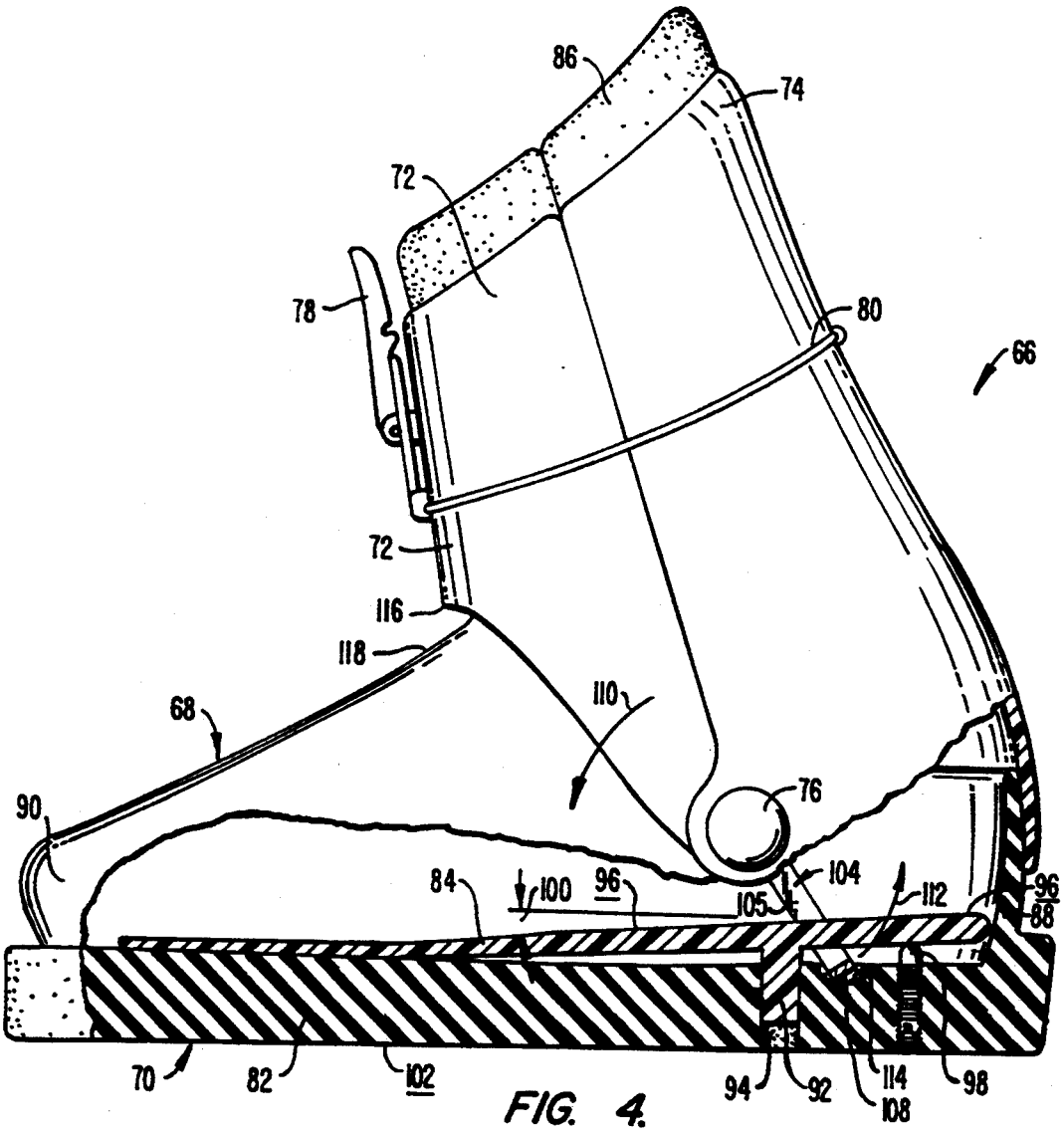
FIG. 4 is a side view of a sport shoe embodiment of the invention showing the footbed at an initial resting position.

Referring now to FIGS. 4 and 4A and 4B, a further embodiment of the invention is disclosed. This embodiment incorporates the dorsiflexion limiting device discussed above with a movable footbed in a sport shoe in the form of a ski boot 66. These devices combine to permit an extended range of forward flexion for the user's leg relative to the sport performing surface while maintaining optimum dorsiflexion coupled with increased boot dynamic tightening during ski maneuvers for greater control. A ski boot 66 includes a shell 68 mounted to a rigid sole 70. The sole is rigidly connected to a ski while performing. Front and rear cuffs 72, 74 are pivotally mounted to shell 68 at pivots 76. An adjustable buckle 78 engages a cable loop 80 to secure front and rear cuffs 72, 74 about the user's lower leg.

Sole 70 includes a rigid base 82 and there is a movable footbed 84 overlying sole 70. The entire boot 66 is lined with a liner 86. However the liner is not shown in the broken out sections for clarity. Footbed 84 extends substantially from the heel 88 to the toe 90 of boot 66 but is not attached to the sole as is footbed 25 shown in FIG. 1. Footbed 84 includes a downwardly extending bar 92 sized for complementary sliding engagement in an aperture 94 formed through base 82 to the exterior of the sole 70. As shown in FIG. 4, the initial angular inclination of the upper surface footsupport 96 of footbed 84 can be adjusted by a set screw 98. For skiing, surface 96 is typically set to incline downwardly from heel 88 towards toe 90 at an initial angle 100 relative to the lower surface 102 of sole 70. Angle 100 is commonly about 9°.

Figure 6:
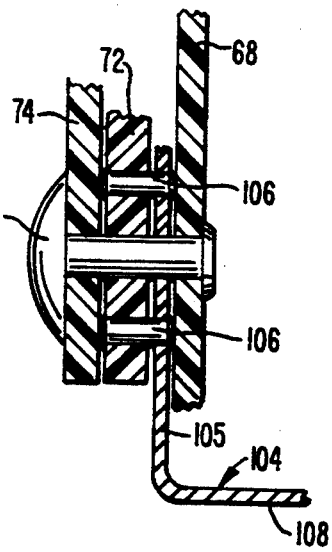
FIG. 6 is an enlarged sectional view showing the yoke connected to the front cuff.
Figure 5:
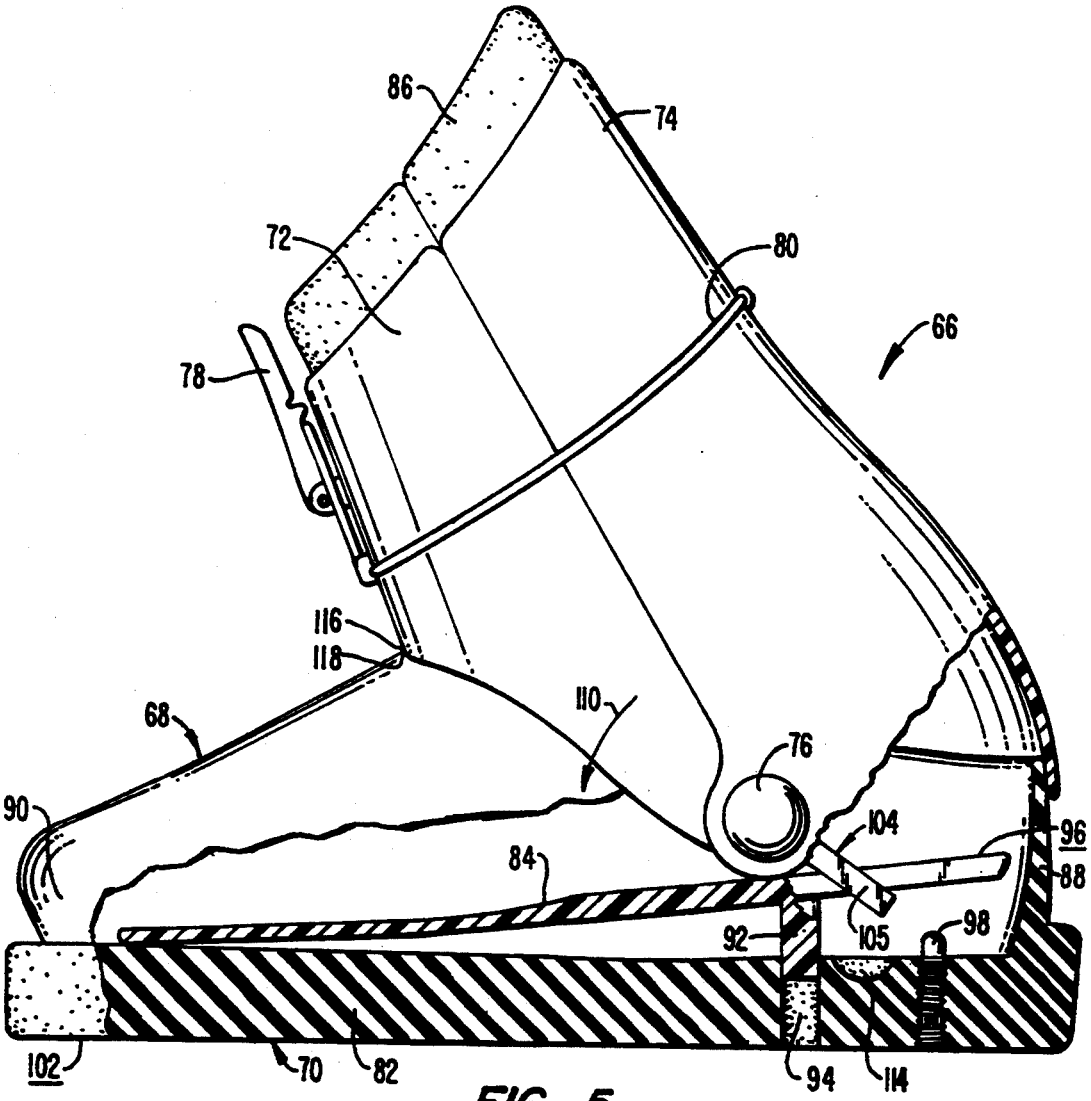
FIG. 5 shows the embodiment of FIG. 4 with the footbed raised and the cuff pivoted fully forward.

A U-shaped yoke 104, shown in FIG. 6, is pivotally mounted at its upper ends 105 to pivots 76. Ends 105 of yoke 104 are also adjustably fastened to front cuff 72 by press bit rivets 106 so that front cuff 72 and yoke 104 pivot together about pivots 76. The generally horizontal portion 108 of yoke 104 lies beneath footbed 84. Pivoting front cuff 72 forwardly in the direction of arrow 110 causes yoke 104 to pivot upwardly in the direction of arrow 112, thus lifting portion 108 from a recess 114 in base 82 of sole 70 to engage footbed 84. Continued forward movement of front cuff 72 causes yoke 104 to raise upper surface 96. Forward movement of cuff 72 is stopped when lower edge 116 contacts shell 68 at a point 118 as shown in FIG. 5. Rearward movement of cuff 72 is stopped when lower edge 116 contacts the upward extension of shell 68 (not shown).

It should be noted that there are two separate angular orientations being considered. The first is the angular orientation between the user's foot and lower leg. Forward flexion of the user's leg from a position perpendicular to the user's foot, called dorsiflexion, is measured from a line perpendicular to surface 96. These angles are illustrated in FIG. 4A. For alpine skiing an initial dorsiflexion of about 9° is presently considered most desirable. Since the upper supporting surface 96 is inclined upwardly and rearwardly at about 9°, the user's leg is initially flexed about 18° forward from the horizontal, that is a line perpendicular to surface 102 on the upper surface of a ski. The lower leg angles relative to the horizontal are shown in FIG. 4B.

In the use of ski boot 66, the user first adjusts the initial inclination of footbed 84 with set screw 98. As stated above, angle 100 is typically about 9°. This adjustment causes a 9° forward inclination of the user's leg with a zero dorsiflexion angle. The initial angle of the user's leg relative to ski surface 102 is indicated by angle 119 and is typically about 18°, reflecting the initial 9° angle of surface 96 and the additional 9° angulation of cuffs 72, 74. The length of the arms 105 of yoke 104 is selected so that portion 108 of yoke 104 lies a predetermined distance below footbed 84 when the user's leg and foot are at an initial dorsiflexion angle 120, typically 9°. The relationships of the pivoting of the front cuff 72 and the pivoting of the footbed 84 is determined by the angle and length of the yoke 104, the position of the set screw 98, and the pivot point of the footbed 84. Thus additional dorsiflexion by the user can occur before portion 108 begins to lift footbed 84 and surface 96. This angle has been empirically determined to be preferably about 3°, so that a dorsiflexion angle of about 12° must occur before the forward flexion of the user's leg will begin to the raise the footbed. This dorsiflexion angle of 12° is considered to be an optimum for downhill skiing and adjustments can be made to take into account individual preferences, skiing ability, etc. The optimum dorsiflexion angle is indicated in FIG. 4A as angle 121. Angle 121 results in a lower leg angle 123, with respect to the horizontal surface 102, of about 21°.

The present invention allows the user to maintain this optimum dorsiflexion angle even while he or she increases his or her forward leg flex relative to the ski surface because yoke 104 increases the angularity of the movable footbed 84 in accordance with the increased forward angulation of cuff 72, 74. In other words, a forward flexion beyond angle 123 results in no further increase in dorsiflexion. In practice it has been found that some further increase in dorsiflexion will usually occur due to yielding of materials and the configuration of yoke 104. Therefore when optimum dorsiflexion is referred to in this application it is to be understood to include a relatively narrow range of dorsiflexion angles over which the athlete can perform at peak levels.

FIG. 5 shows front cuff 72 in its forwardmost position when edge 116 contacts shell 68 at point 118. This position illustrates an additional pivotal movement of front cuff 72 of approximately 10° after surface 96 begins to be lifted by yoke 104 and corresponds to a maximum lower leg angle 125 of about 31°. However, because of the upward movement of surface 96 in the direction of arrow 112, the dorsiflexion angle has remained substantially constant.

Figure 7:
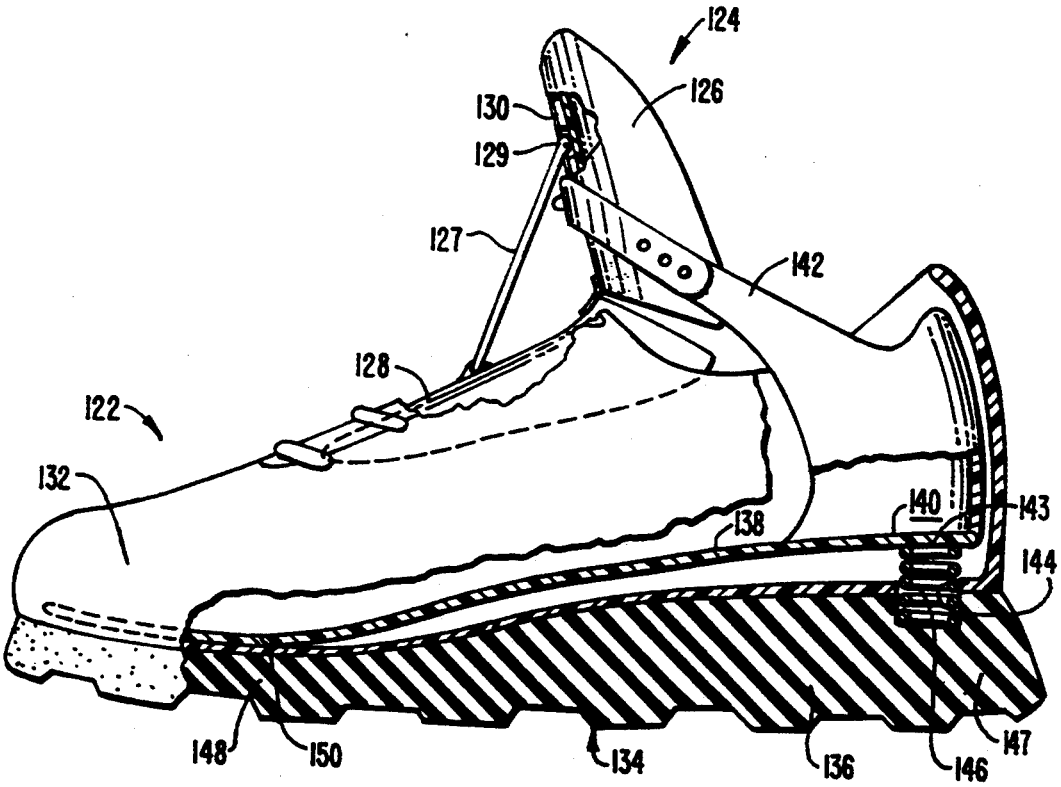
FIG. 7 is a side view of a sport shoe embodiment of the invention with a semirigid sole and a movable footbed.

Referring now to FIG. 7, a sport shoe in the form of a soccer shoe 122, incorporating some of the features of both sport shoe 34 and 66, is disclosed. Sport shoe 122 includes a tongue assembly 124 similar to tongue assembly 44 shown in FIG. 3. A rigid brace 127 can be pivotally mounted to the lower tongue 128 and is slidably connected to upper tongue 126. An upper end 129 of brace 127 is enlarged for sliding fit within a slot 130 in semirigid upper tongue 126. When end 129 engages the outer end of slot 130, its forward pivotal movement, and thus further dorsiflexion, is stopped.

Shoe 122 also includes a two part sole 134 having a sole 136 and a movable footbed 138 overlying the sole within the shoe. A shell 132 is attached to sole 136. The upper foot supporting surface 140 of footbed 138 is connected to pivotal upper tongue 126 by an adjustable length heel strap assembly 142. Assembly 142 lifts the heel end 143 of footbed 138 in response to the forward pivoting of upper tongue 126. A compression spring 144 is partially housed within an opening 146 formed in sole 136. Spring 144 acts to keep the heel 147 of shoe 122 on the performing surface even though end 143 of the footbed 138 may be pivoted upwardly by tongue 126.

In the use of sport shoe 122, the user can adjust when footbed 138 begins to be raised by suitably changing the length of strap assembly 142. There can be initial, free dorsiflexion movement. However, unless the upper tongue 126 has pivoted sufficiently to drive end 129 of brace 127 against the outer end of slot 130, further dorsiflexion movement ceases. Alternatively, strap assembly 142 can be used to limit forward angulation of upper tongue 126. Dorsiflexion movement ceases when the foot is pressed against the upper shell 132. Further forward flexion of user's leg relative to the sport performing surface results in flexion of the metatarsal phalangeal areas 148, 150 of sole 136 and footbed 138, respectively.

Figure 8:
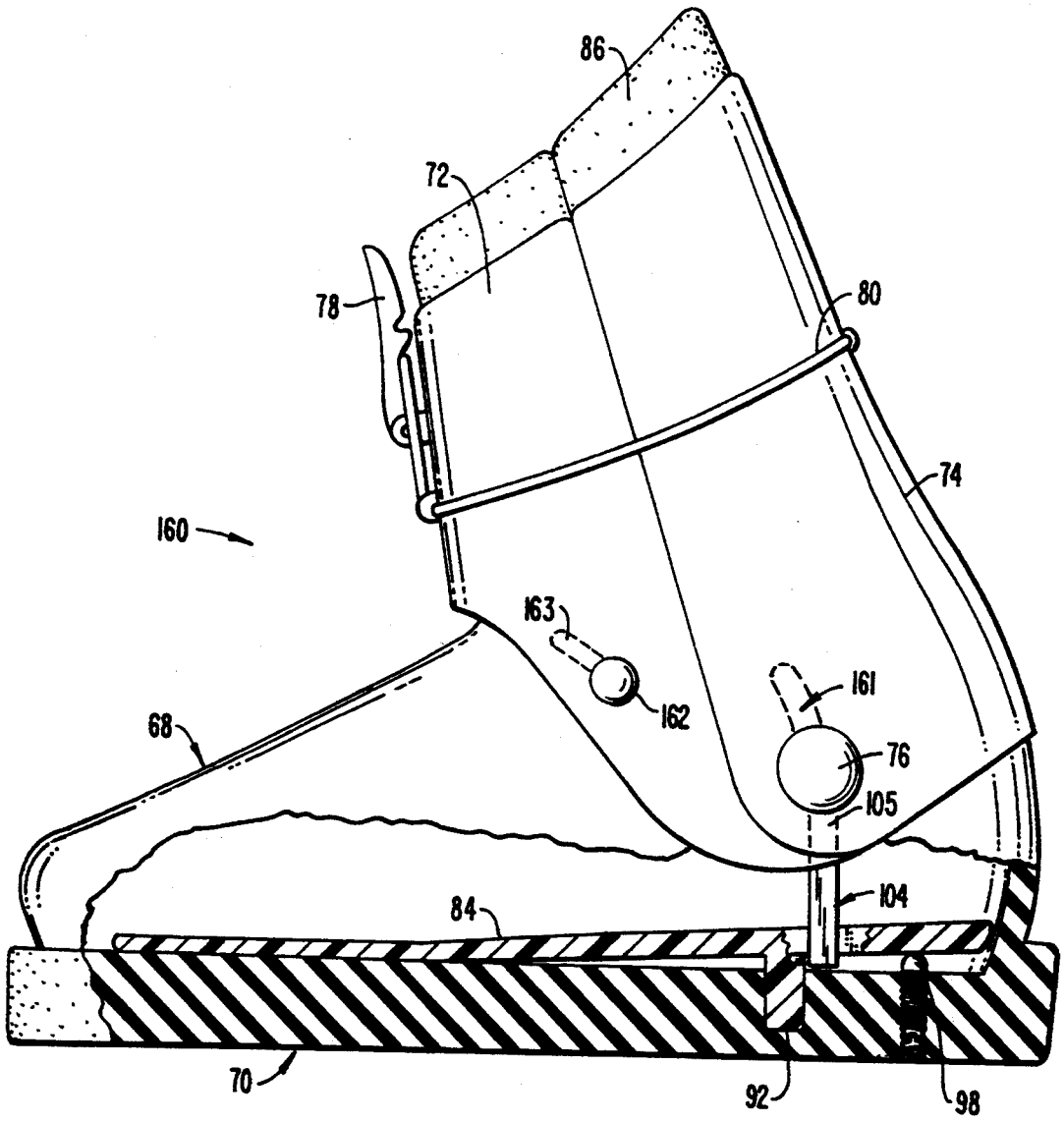
FIG. 8 is a side view of a sport shoe embodiment of the invention showing the pivots and yoke.
Figure 9:
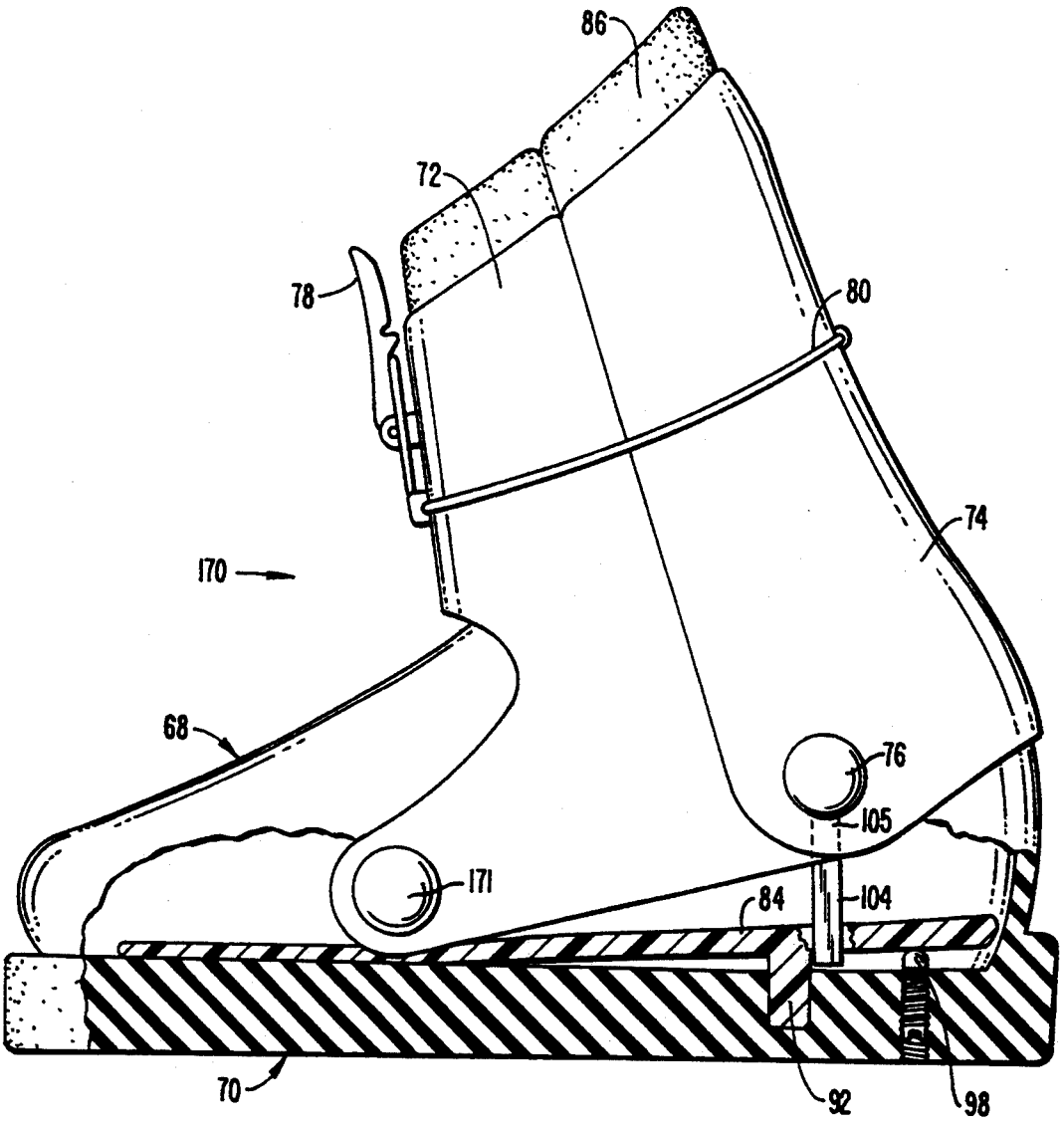
FIG. 9 is a side view of an alternative sport shoe embodiment of the invention showing the pivots and yoke.

Referring now to FIGS. 8 and 9, further embodiments of the invention are disclosed. These embodiments also incorporate the dorsiflexion limiting device and have identical parts numbered as the embodiment disclosed in FIGS. 4, 4A, and 4B. Ski boot 160 of FIG. 8 includes a shell 68 mounted to a rigid sole 70 with front and rear cuffs 72 and 74. Front and rear cuffs 72 and 74 are pivotally and slidably mounted to shell 68 by pivots 76 at cutout 161. In a similar manner, front cuff 72 is pivotally and slidably mounted to shell 68 by pivot 162 at cutout 163. The arcs of cutouts 161 and 163 are located to be proximate to the pivot of the ball of the foot or pivot point of the foot supporting surface movable footbed 84. As the user leans forward in the boot, cuffs 72 and 74 pivot forwardly and upwardly, sliding along cutouts 161 and 163. In this embodiment, U-shaped yoke 104 is pivotally and rotatably mounted at its upper ends 105 to pivots 76. When cuffs 72 and 74, along with pivots 76 and 162 move forwardly and upwardly along cutouts 161 and 163 in shell 68 by the movement of the user leaning forward in the boot, yoke 104 pivots footbed 84 proximate the ball of the foot, maintaining the optimum angle of dorsiflexion.

FIG. 9 discloses an alternative ski boot 170 embodiment which includes a shell 68 mounted to a rigid sole 70 with front and rear cuffs 72 and 74. Front and rear cuffs 72 and 74 are pivotally mounted to each other by pivots 76 which pass through both cuffs but not through shell 68. In addition, there is also shown pivot 171 which passes through cuff 72 and shell 68 forming the pivot point of the cuff 72 which is proximate the pivot point of the footbed 84 of the boot 170. Pivot 76 is provided for opening of the rear cuff 74 for entry of the user's foot into the boot. After the user has placed his foot in the boot, cuffs 72 and 74 are closed with cable 80 by the movement of buckle 78. Yoke 104 is pivotally and rotatable mounted at its upper ends 105 to pivots 76. When there is forward flexion of the leg in the boot, cuffs 72 and 74 together move forwardly and upwardly about pivot 171, lifting yoke 104 and pivoting footbed 84 proximate the ball of the foot, maintaining the optimum angle of dorsiflexion of the leg relative to the foot while permitting further forward flexion of the leg relative to the sole of the boot and the sport performing surface.

Modification and variation can be made to the disclosed embodiments without departing from the subject of the invention as defined in the following claims. For example, tongue assembly 44 may be constructed as a rigid, unitary member rather than a hinged, adjustable member.

We claim:

1. A sport shoe, for use on a sport shoe performing surface, comprising:

a sole having a sole surface for placement on and support by the sport shoe performing surface;

a shell extending from the sole;

means for tightening the shoe to a close fit on a foot located in the shoe;

means for permitting forward flexion of a leg relative to the foot located in the shoe while the sole surface is placed on and supported by the shoe performing surface from a first leg/foot angle to a predetermined leg/foot angle while the tightening means maintains the close fit of the shoe on the foot;

the predetermined leg/foot angle of the leg relative to the foot corresponding to a first leg/surface angle of the leg relative to the sport shoe performing surface;

means for limiting forward flexion of the leg relative to the foot beyond the predetermined leg/foot angle; and means for automatically permitting further forward flexion of the leg relative to the sport shoe performing surface from the first leg/surface angle to a second leg/surface angle while substantially maintaining the predetermined leg/foot angle while the sole Surface is placed on and supported by the shoe performing surface.

2. A sport shoe according to claim wherein said means for limiting forward flexion includes an upwardly extending limit member.

3. A sport shoe according to claim wherein said means for limiting forward flexion includes adjusting means.

4. A sport shoe according to claim 2 wherein said further forward flexion automatically permitting means further includes a footbed movable relative to said sole.

5. A sport shoe according to claim 4 wherein said footbed is coupled to said limit member.

6. A sport shoe according to claim 5 wherein said limit member is movable relative to said sole.

7. A sport shoe according to claim 4 wherein said footbed includes means for adjusting the angle of the footbed relative to the sole.

8. A ski boot, for use on a ski surface, comprising:

a relatively rigid sole having a sole surface for placement on and support by the ski surface;

a shell extending from the sole;

a cuff and footbed incorporated in the shoe and movable relative to the shoe;

the cuff being movable with respect to the shell to permit forward flexion of a leg relative to a foot located in the shoe from a first leg/foot angle to a predetermined leg/foot angle while the sole surface is placed on and supported by the ski surface;

the predetermined leg/foot angle of the leg relative to the foot corresponding to a first leg/surface angle of the leg relative to the sport shoe performing surface;

means for limiting movement of the cuff relative to the footbed to limit forward flexion of the leg relative to the foot beyond the predetermined leg/foot angle; and means for coupling the cuff to the footbed to permit further forward flexion of the leg relative to the sport shoe performing surface from the first leg/surface angle to a second leg/surface angle while substantially maintaining the predetermined leg/foot angle while the sole surface is placed on and supported by the ski surface.

9. A ski boot according to claim 8 wherein said footbed is coupled to said cuff by an adjustable yoke.

10. A sport shoe, for use on a sport shoe performing surface, comprising:

a relatively rigid sole having a sole surface for placement on and support by the sport shoe performing surface;

a shell extending from the sole;

a cuff and footbed incorporated in the shoe and movable relative to the shell;

means for securing a foot within the shoe by manipulation of said securing means from a pre-use condition to an in-use conditions, at which the foot fits snugly in the shoe;

the cuff being movable with respect to the shell with the securing means in the in-use condition to permit forward flexion of a leg relative to the foot from a first leg/foot angle to a predetermined leg/foot angle while the securing means maintains the in-use condition while the sole surface is placed on and supported by the sport shoe performing surface;

the predetermined leg/foot angle of the leg relative to the foot corresponding to a first leg/surface angle of the leg relative to the sport shoe performing surface;

means for limiting movement of the cuff relative to the shell with the securing means in the in-use condition to limit forward flexion of the leg relative to the foot beyond the predetermined leg/foot angle; and means for coupling the cuff to the footbed to permit further forward flexion of the leg relative to the sport shoe performing surface from the first leg/surface angle to a second leg/surface angle while substantially maintaining the flexion of the leg relative to the foot at said predetermined angle while the sole surface is placed on and supported by the sport shoe performing surface.

11. A sport shoe comprising:

a sole having a surface for placement on and support by a sport shoe performing surface while practicing a sport;

a shell extending upwardly from the sole;

means for tightening the shoe to a close fit on the foot when it is located in the shoe;

first means in engagement with the foot and the leg when the foot is located in the shoe for permitting relative dorsiflex movements in a given direction between the foot and the leg through a first angle having a predetermined magnitude while maintaining the foot in a fixed position relative to the sole and while the sole surface is placed on and supported by the shoe performing surface; and second means for simultaneously moving the foot and the leg with respect to the sole after the dorsiflex movements to change an angle between the leg and the sole while preventing dorsiflex movements between the foot and the leg and while the sole surface is placed on and supported by the shoe performing surface.

12. A sport shoe, for use on a sport shoe performing surface, comprising:

a sole having a sole surface for placement on and support by the sport shoe performing surface;

a shell extending from the sole;

means for tightening the shoe to a close fit on a foot located in the shoe;

means for permitting forward flexion of a leg relative to the foot located in the shoe while the sole surface is placed on and supported by the shoe performing surface from a first leg/foot angle to a predetermined leg/foot angle while the tightening means maintains the close fit of the shoe on the foot;

the predetermined leg/foot angle of the leg relative to the foot corresponding to a first leg/surface angle of the leg relative to the sport shoe performing surface;

means for limiting forward flexion of the leg relative to the foot beyond the predetermined leg/foot angle;

means for automatically permitting further forward flexion of the leg relative to the sport shoe performing surface from the first leg/surface angle to a second leg/surface angle while substantially maintaining the predetermined leg/foot angle while the sole surface is placed on and supported by the shoe performing surface; and said means for limiting forward flexion being located inside of the shoe.

13. A sport shoe, for use on a sport shoe performing surface, comprising:

a sole having a sole surface for placement on and support by the sport shoe performing surface;

a shell extending from the sole;

means for tightening the shoe to a close fit on a foot located in the shoe;

means for permitting forward flexion of a leg relative to the foot located in the shoe while the sole surface is placed on and supported by the shoe performing surface from a first leg/foot angle to a predetermined leg/foot angle while the tightening means maintains the close fit of the shoe on the foot;

the predetermined leg/foot angle of the leg relative to the foot corresponding to a first leg/surface angle of the leg relative to the sport shoe performing surface;

means for limiting forward flexion of the leg relative to the foot beyond the predetermined leg/foot angle, said means for limiting forward flexion including an upwardly extending limit member, said limit member being movable relative to said sole;

means for automatically permitting further forward flexion of the leg relative to the sport shoe performing surface from the first leg/surface angle to a second leg/surface angle while substantially maintaining the predetermined leg/foot angle while the sole surface is placed on and supported by the shoe performing surface, said further forward flexion automatically permitting means further including a footbed coupled to said limit member and movable relative to said sole; and said footbed being raised only when said limit member is moved beyond a first predetermined angle.

14. A sport shoe according to claim 13 wherein said footbed increases the tightness of the fit of the shoe when said footbed is raised.

15. A sport shoe according to claim 13 wherein said footbed includes a heel portion, the heel portion being raised when said limit member is moved beyond a second predetermined angle.

16. A sport shoe according to claim 13 wherein said footbed is pivoted about the metatarsal phalangeal area.

17. A sport shoe according to claim 13 wherein said footbed is raised after said limit member is moved from a predetermined resting angle to a predetermined optimum angle.

18. A sport shoe according to claim 13 wherein said footbed is coupled to said limit member by a yoke.

19. A sport shoe according to claim 13 wherein said yoke is adjustable relative to said limit member.

20. A sport shoe according to claim 13 wherein said yoke includes a generally horizontal portion for raising said footbed.

* * * * *